United States Patent [19]

Groenendaal, Jr. et al.

[11] Patent Number: 5,024,579

[45] Date of Patent: Jun. 18, 1991

[54] FULLY FLOATING INLET FLOW GUIDE FOR DOUBLE-FLOW LOW PRESSURE STEAM TURBINES

[75] Inventors: John C. Groenendaal, Jr., Winter Springs; Randy T. Rudy, Orlando, both of Fla.

[73] Assignee: Westinghouse Electric Corp., Pittsburgh, Pa.

[21] Appl. No.: 553,517

[22] Filed: Jul. 18, 1990

[51] Int. Cl.[5] ..... F01D 25/26

[52] U.S. Cl. ..... 415/108; 415/138; 415/170.1; 29/525.1; 29/888

[58] Field of Search ..... 415/108, 134, 136, 137, 415/138, 139, 170.1, 174.2, 174.5; 29/888, 888.01, 888.011, 888.012, 888.02, 888.021, 525.1, 46 A, DIG. 48

[56] References Cited

U.S. PATENT DOCUMENTS

| | | | |
|---|---|---|---|
| 4,701,102 | 10/1987 | Pisz et al. | 415/136 |
| 4,764,084 | 8/1988 | Parker et al. | 415/101 |
| 4,786,232 | 11/1988 | Davis et al. | 415/138 |
| 4,826,395 | 5/1989 | Groenendaal, Jr. | 415/101 |
| 4,863,341 | 9/1989 | Groenendaal | 415/134 |

*Primary Examiner*—Edward K. Look

*Assistant Examiner*—Christopher M. Verdier

[57] ABSTRACT

A fully-floating inlet flow guide for a double-flow steam turbine includes a pair of partially overlapping, generally cylindrical sealing rings circumscribing a turbine rotor adjacent a steam inlet with each of the bands being coupled to a respective one of a pair of first stage nozzle rings positioned on opposite sides of the inlet for directing steam into an axial flow path. The rings are provided with an annular seal at their overlapping portions such that axial expansion and contraction is accommodated without steam leakage through the seal. Radial expansion and contraction of the sealing rings is accommodated by attachment of each ring to a respective nozzle using a circumferential groove in a radially inner surface of each nozzle ring diaphragm and a tongue on each of the rings which fits into a respective groove. Each tongue has a plurality of circumferentially spaced slots and a block slidingly positioned in each of the slots. A pin extends through the blade diaphragm at each slot and extends through the corresponding block so that the blocks are fixed with respect to the diaphragm. The blocks prevent rotation of the bands about the turbine rotor while permitting radial displacement of the bands since the blocks are only slidingly held in the slots.

6 Claims, 3 Drawing Sheets

FULLY FLOATING INLET FLOW GUIDE FOR DOUBLE-FLOW LOW PRESSURE STEAM TURBINES

FIELD OF THE INVENTION

The present invention relates to steam turbines and, more particularly, to the inlet structure of double-flow steam turbines for deflecting and directing the flow of steam into blades of the turbine

BACKGROUND OF THE INVENTION

In typical double-flow steam turbines, a flow of motive steam is provided through an opening in an outer casing to an inlet chamber in an inner casing whereupon the steam is directed onto a first pair of annular rows of stationary blades positioned on either side of the middle of the turbine A number of such rows of stationary blades are fixed to the inner casing through attachment, by any one of several known methods, to an outer blade ring, of which there are several types. The radially inner end of the stationary blades is often terminated in a circumferential inner support ring which may be attached to the blades or may be formed integrally therewith. A bearing mounted rotor, having a number of annular rows of blades disposed about the periphery of the rotor is positioned within the inner casing so that the rotor blades are cooperatively associated with the rows of stationary blades. As the motive steam flows and expands from the turbine middle outward, stationary blades serve to direct the motive steam in a desired flow path onto the rotor blades to motivate the rotor in a well known manner.

In the above described double-flow steam turbines, the steam entering the turbine is directed transverse to the rotor axis, i.e., radially inward. As the steam reaches the area of the rotor blades, it must be turned through 90° and then redirected by means of a first stationary circumferential row of blades onto a first stage of rotating blades. The operation of this first stationary blade row is important to the efficiency of the turbine since its purpose is to direct the steam entering the inlet into a preferred flow path onto the first row of rotating blades. Because there is a stationary blade connected to the static structure of the turbine and which is positioned adjacent the rotating rotor, there is necessarily formed a gap between a radially inward end of the first stationary blade row and the adjacent rotor. In many such turbines, steam entering the inlet may bypass the blades on the first blade row and flow around the ends of these blades through the gap between the inner support ring and the adjacent rotor. Because this steam is not directed into the desired steam flow path, it does not enter the first rotating blade row at the preferred angle and thus does not efficiently transfer its energy to the rotating blade row.

At least one form of apparatus utilized to avoid the loss of efficiency by steam flowing around the first stationary blade row is shown in U.S. Pat. No. 4,826,395 issued May 2, 1989 to Groenendaal, Jr. and assigned to Westinghouse Electric Corporation. This patent describes a system for use with double-flow steam turbines of the type in which the first stationary blade row comprises individually mounted blades and does not have a radially inner ring supporting the blades although the blade ends are fixed to a shroud. The apparatus as described therein comprises a pair of annular bands which circumscribe the rotor about its centerline with one of the bands being connected to the first row of stationary blades on one side of the inlet and the other band being connected to the first row of stationary blades on an opposite side of the inlet. The connection to the blades is a fixed or hard connection which does not provide for any relative movement between the connected band and the associated blades. At the junction between the two bands, there is an overlapping arrangement with a resilient seal positioned in one of the bands in a location so as to provide a frictional engagement with the other of the bands. This double band seal arrangement prevents steam from leaking between the bands and prevents steam from bypassing the first blade rows by passing around the ends of the blade row diaphragms. While this arrangement is suitable for some of the double-flow low pressure steam turbines, it does not provide for differential radial expansion but only for axial expansion between the opposed blade rows and it further does not provide for a method of connecting the circumscribing seal bands to a blade row of the type diaphragm having a inner ring.

Consequently, there is a need for a double-flow steam turbine which includes structure for preventing the flow of steam from circumventing the desired flow path in a turbine of the type having blade row diaphragms with inner diaphragm rings.

SUMMARY OF THE INVENTION

It is an object of the present invention to provide a double-flow steam turbine which includes structure for preventing the flow of steam from circumventing the inner rings of first stage stationary blade row diaphragms.

It is another object of the present invention to provide a double-flow steam turbine which incorporates a sealing arrangement which accommodates both radial and axial differential thermal expansion.

The above and other objects, features, and advantages are obtained in a double-flow steam turbine having a rotor having annular rows of blades disposed about its periphery and a stator assembly connected about the rotor and having annular rows of stationary blades radially depending therefrom. The stator assembly includes a steam inlet for directing a flow of steam onto at least a pair of opposing stationary blade rows in oppositely directed steam flow paths. The first stationary blade rows are positioned on opposite sides of the steam inlet and are oriented for directing the incoming flow of steam toward corresponding blades of the rotor. The first stationary blade rows each have an inner blade ring for supporting the blades. The blade ring is spaced from an adjacent rotating portion of the rotor such that a gap is defined between the stationary blade row ring and the rotor structure. Steam leakage around the inner diaphragm rings and through the gap is prevented by a pair of sealing rings or bands circumscribing the rotor with at least a portion of one of the bands overlapping a portion of the other of the bands. A resilient seal is coupled to one of the bands at the overlapping point and is in frictional engagement with the other band.

Each of the first and second stationary bands is connected to a corresponding one of the first stationary blade rows by apparatus which allows differential radial thermal expansion and contraction between the band and associated blade row. The connecting apparatus comprises a circumferential groove formed in a radially inner surface of each of the diaphragm inner rings and a tongue formed on each of the first and second bands and positioned to fit within a respective one of the grooves. Each of the tongues has a plurality of circumferentially spaced slots and a block is positioned in each of the slots. Each block is sized to slidingly engage opposite circumferential sides of the slot and is shorter than the depth of the slot so that the block can slide in a radial direction within the slot. The blocks are located within the groove in the inner rings when the bands are assembled to the blade rows. A pin extends through the diaphragm inner ring at each block location and passes through an aperture in the block to fix the block to the inner blade ring. Since only the blocks are fixed to the diaphragm inner ring and since these blocks are slidingly positioned within the slots in the tongue on the seal bands, the seal bands are free to float or differentially expand in a radial direction. The blocks are captured in the slots and thus prevent the bands from rotating about the rotor while, at the same time, the bands are supported vertically and aligned transversely by the blocks.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
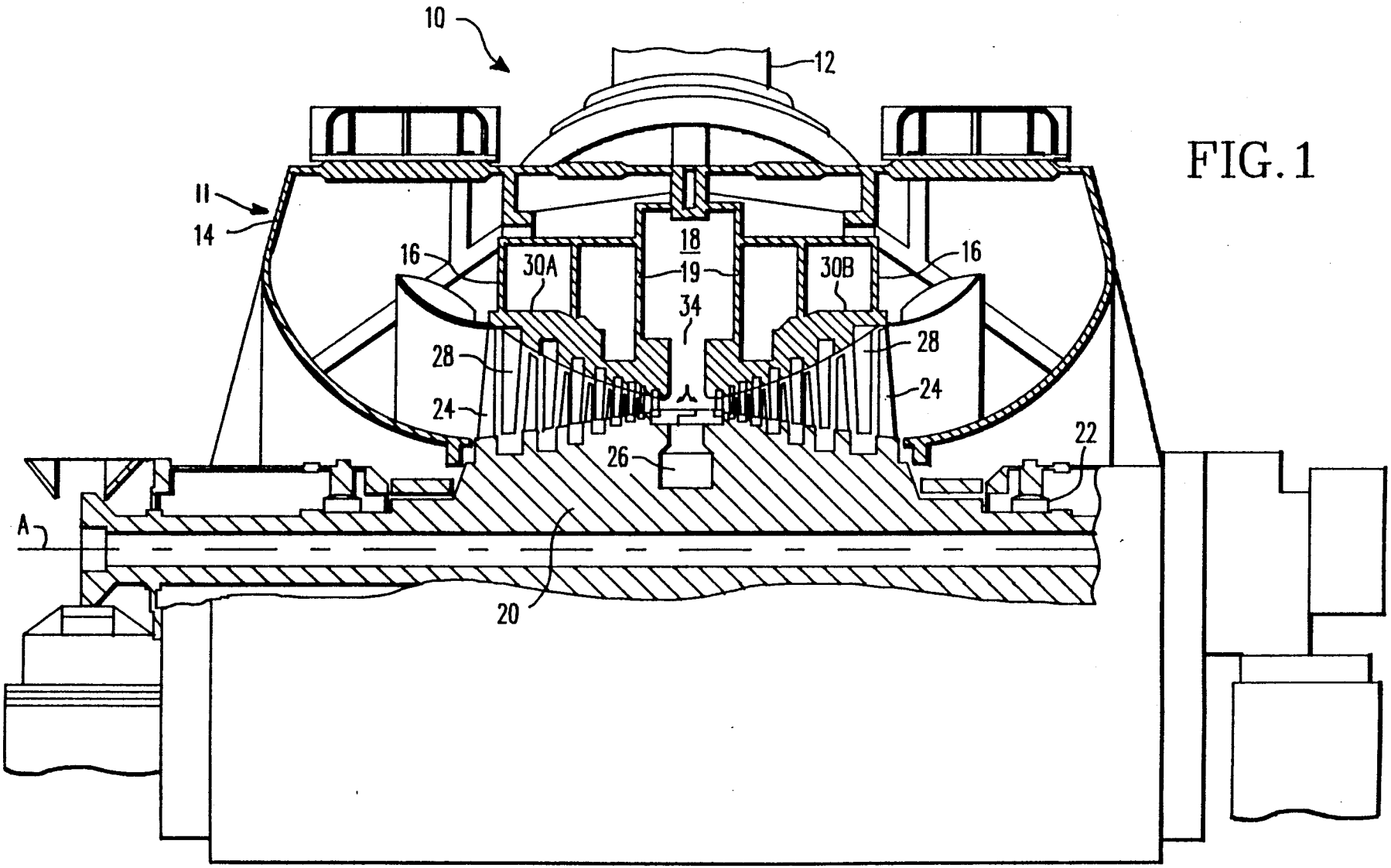
FIG. 1 is a section view of a double-flow steam turbine of the type with which the present invention may be used.

Referring first to FIG. 1, there is shown a double-flow low pressure steam turbine to which the present invention may be applied and which is utilized to illustrate the principals of the invention. The turbine is indicated generally at 10 in FIG. 1 and receives a supply of steam from a source (not shown) connected to the turbine 10 through conduit 12 which is attached to outer casing 14. The flow of steam passes through an opening in the outer casing, through an opening in an inner casing 16 and into an inlet chamber 18. The chamber 18 is defined by various central sidewalls 19 in the inner casing. Inner casing 16 is divided into upper and lower halves (not shown) which are joined along a horizontal joint flange in a well known manner.

A rotor 20 is mounted in bearings 22 to rotate about an axis of rotation "A". A number of annular rows of radially extending blades 24 are disposed about the periphery of rotor 20. The rows of blades 24 are axially spaced on either side of a rotor midpoint 26. Blades 24 contained at each row are substantially a uniform blade length on a given row. Blade length increases for each row the further that row is axially disposed from rotor midpoint 26.

A stationary or stator assembly 11 is arranged about rotor 20 and is shown to include a number of stationary annular rows of blades 28 which are operatively positioned in relation to rotor blades 24 for directing the flow of steam onto rotor blades 24. Stationary blades 28 are positioned through their attachment to radially outer support structures 30A and 30B which in turn are attached to the inner casing on either side of midpoint 26. Although not shown, it will be understood that the stator assembly is divided into upper and lower halves which are attached to the upper and lower halves of the inner casing. The attachment of the outer support members 30A and 30B on either side of rotor midpoint 26 is such that an opening or inlet 34 is formed in the stator assembly for directing the flow of steam toward midpoint 26. However, as will become apparent, the flow is turned as it exits inlet 34 and directed into the turbine blades.

Figure 2:
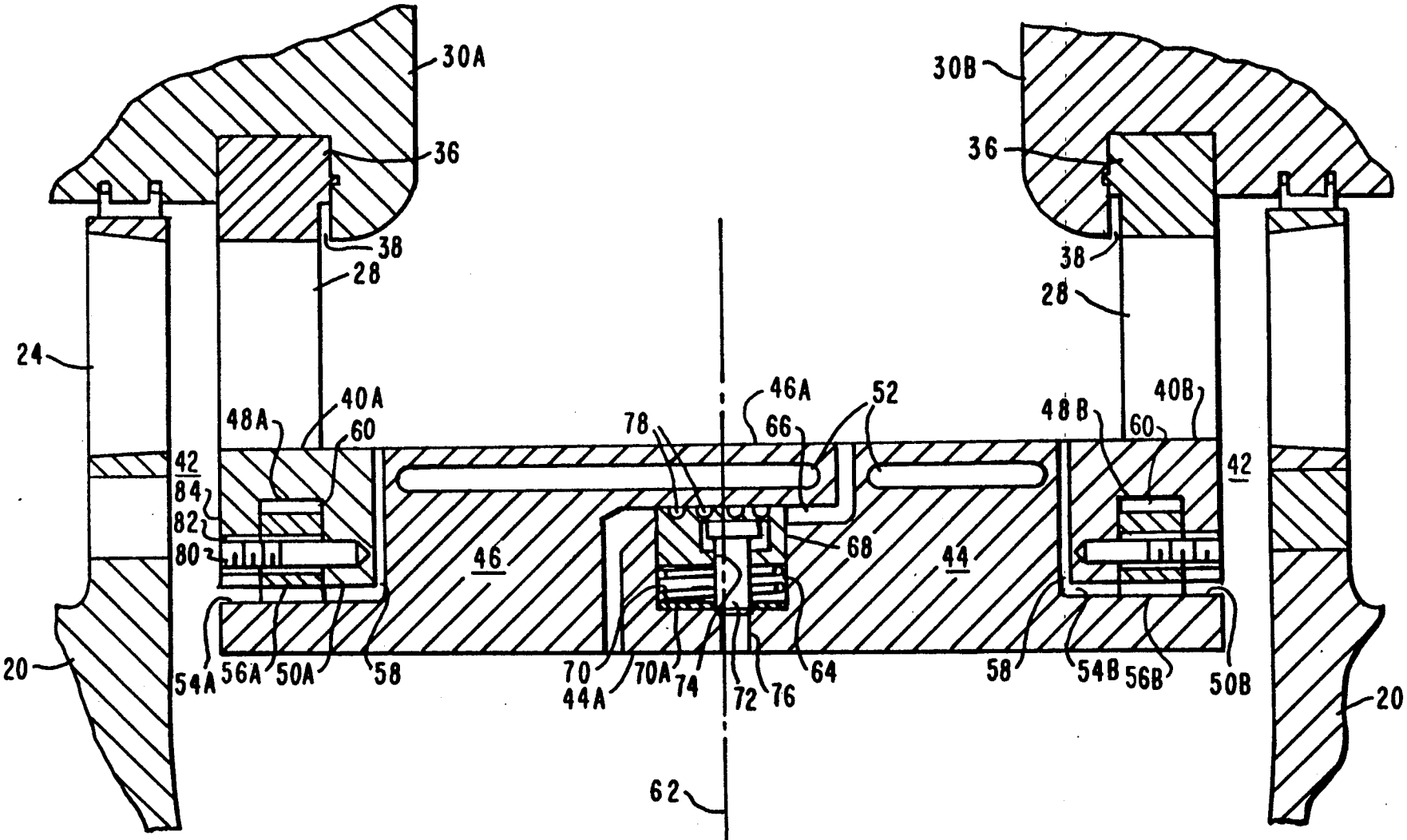
FIG. 2 is an enlarged sectional view of a preferred embodiment of the present invention contained within the turbine shown in FIG. 1.

As the flow of steam passes through inlet 34, it is presented to the first rows of stationary blades 28 oppositely positioned on either side of inlet 34. Referring now to FIG. 2, each blade 28 is seen to have a root or outer support ring 36 positioned in corresponding grooves 38 in the outer support members 30A and 30B. Each blade further includes a radially inner support ring 40A and 40B attached to the radially inner end of the blades 28 by means well known in the art such as rivets or being formed integrally with the blades 28.

In order to prevent contact and allow for differential thermal expansion between the stationary inner rings 40A and 40B and adjacent portions of rotor 20, a gap 42 is provided therebetween. Without providing any further structure, it will be understood that a portion of the flow of steam could escape from or circumvent the desired flow path, i.e., through stationary blades 28, and could instead pass around the inner support ring 40 and through gap 42. Since steam passing through the gap 42 will not have been given a predetermined direction by stationary blade 28, the turbine efficiency will be reduced since the steam passing through the gap 42 will not be directed in such a manner as to efficiently act on the adjacent rotating blades 24.

As indicated previously, various methods have been proposed for providing a seal which will prevent steam from passing around the blades 28 and entering into the rotating blades 24 without having been given a preferred direction. In the aforementioned U.S. Pat. No. 4,826,395, the proposed method included attaching a pair of circumferential bands to each of the first rows of stationary blades with the ends of the bands overlapping and including a resilient seal for preventing steam from entering into the area below the stationary blades. In the embodiment therein described, the bands were fixedly attached to the radial inner ends of the stationary blades and included an overlapping joint which permitted axial expansion and contraction with respect to the turbine centerline but did not accommodate radial thermal expansion or contraction. In this regard, the seal described in U.S. Pat. No. 4,826,395 can be characterized as a semi-floating seal in that it only provided for thermal differential expansion in the axial direction.

The seal arrangement illustrated in FIG. 2 provides a fully floating seal in which both radial and axial thermal expansion are permitted. A first circumferential seal carrier ring or sealing band 44 is coupled to the inner ring 40B and a second seal land ring or sealing band 46 is coupled to the inner ring 40A. The method of coupling the bands 44 and 46 utilizes a tongue and groove arrangement which permits radial motion of the bands 44 and 46 with respect to the blades 28. In particular, each of the inner rings 40A and 40B include corresponding grooves 48A and 48B formed in a radially inner surface 50A and 50B, respectively, of the inner rings 40A and 40B.

It will be appreciated that the blade 28 in each of the first annular rows of blades is only one of a plurality of blades 28. The blades 28 are circumferentially spaced about the rotor 20 and in combination with the outer ring 36 which holds the outer edges of the blades 28 and the inner ring 40 which holds the radially inner end of the blades 28, form what is sometimes referred to as a nozzle or diaphragm. The outer ring 36 and inner ring 40 are formed as two 180° segments so that the diaphragm is formed as two semi-circular halves. The outer ring 36 and inner ring 40 of each blade 28 may be formed of a plurality of separate blade supports which are welded together to form the 180° segments. The grooves **48*a* and 48*b* therefore extend completely around the rotor 20 in the inner ring 40. Each of the seal bands 44 and 46 are similarly formed of 180° segments which may be joined with mating 180° segments to form a full band extending completely around the rotor 20. In the view illustrated in FIG. 2, there is shown an elongated aperture 52 formed in the ends of each of the seal band segments 44 and 46. The apertures 52 are positioned to accept alignment keys (not shown) which extend between the adjacent 180° segments so as to allow the segments to be aligned in a full circumferential seal. If desired, the seal bands 44 and 46** could be formed in smaller segments, i.e., less than 180°, and then joined together by alignment keys as described above.

On opposite sides of each of the seal bands 44 and 46, there are provided land areas **54*a* and 54*b* which extend adjacent the radial inward surfaces 50A and 50B of the inner rings 40. Protruding radially outward from each of the land areas 54A, 54B, is a respective circumferential tongue 56A, 56B. The tongues 56A and 56B are of a size to slidingly fit within the grooves 48*a* and 48*b* in each of the inner rings. In essence, the assembly is a tongue and groove connection. It will be noticed that there is a gap between the land surface 54A and the adjacent surface 50A of the inner ring 40. The gap 58 provides space for radial differential thermal expansion between the inner ring 40 and the seal band 46. A similar gap 60 exists between a top surface of the tongues 56*a* and 56*b* and the bottom of the grooves 48*a* and 48*b***.

The seal bands 44 and 46 are formed as two separate and independent bands in order to allow axial thermal expansion between the opposite halves of the steam turbine with respect to centerline 62. Since the bands 44 and 46 are separate and independent, some additional seal must be provided at their junction in order to prevent steam leakage through the joint between these seal bands. In this instance, the seal band 44, which may be referred to as a seal carrier ring, has a portion indicated at 44A which extends under an overlapping portion 46A of band 46. The band 46 may be referred to as a seal land ring. A groove 64 is formed in the radially outer surface 66 of the portion 44A and a circumferential resilient seal 68 is placed in this groove 64. The seal 68 is biased radially outward by a spring 70 located in the groove 64 below the seal 68. Although a coil spring is shown symbolically in the illustration, it is preferred to use flat so-called "buggy springs" to provide the necessary biasing action to seal 68 and such a flat spring is indicated in cross-section at 70A. It is only necessary that resilient seal 68 be biased with enough force to prevent steam from circumventing the desired flow path and not be biased with such force that axial sliding movement cannot occur between seal 68 and seal land ring or band 46. Such axial movement between seal 68 and seal land ring 46 prevents the transfer of thermal loads between the opposed first stage stationary blade rows 28. Resilient seal 68 is held in place during turbine assembly by shoulder bolt 72 passing through a bore 74 formed in seal 68 and threadedly engaging a bore 76 formed in the seal carrier ring 44. As can be seen in FIG. 2, the bottom surface formed by bore 74 engages the head portion of bolt 72 during assembly due to the biasing action of spring 70. Resilient seal 68 is shown to be provided with a number of ridges 78 formed in the surface which frictionally engages the lower surface of portion 46A of the seal land ring. The seal 68 with its multiple ridges 78 is sometimes referred to as a labyrinth seal.

The tongues **56*a* and 56*b* are held in position within the grooves 48*a* and 48*b* by means of pins 80 which extend through one sidewall of the inner ring 40 and into a second or opposite sidewall of the ring 40. The pins 80 may be press-fit into apertures 82 formed in the sidewalls of the grooves 48*a* and 48*b* or at least one of the sidewalls may be provided with a threaded aperture for accepting a pin having threads on at least one end. In the illustration in FIG. 2, the aperture 82 through the sidewall 84 is provided with threads and the pin 80** is threaded on the end which mates with that aperture when the pin is fully inserted.

Figure 4:
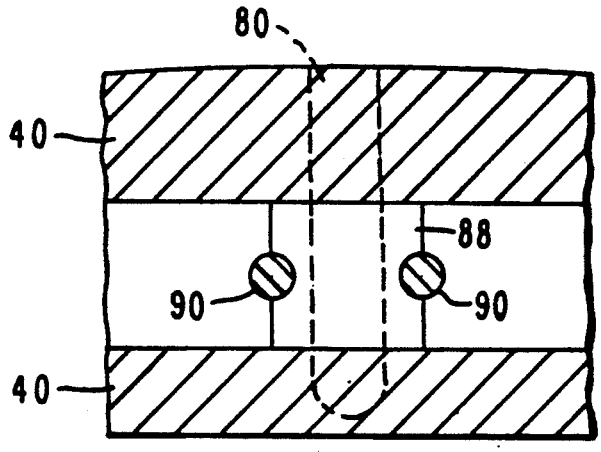
FIG. 4 is a top cross-sectional view of the apparatus of FIG. 3.

In the illustration of FIG. 2, it will appear that the pins 80 extend through the tongues **56*a* and 56*b* and thus couple the seal segments to the diaphragm inner ring 40 in such a manner that differential radial expansion is not possible. However, by reference to FIG. 3, it will be seen that the tongues 56*a* and 56*b* are provided with circumferentially spaced slots 86 with each slot having positioned therein a slidable block 88. The blocks 88 are designed to have a width in the direction illustrated in FIG. 2 which is the same as the width of the tongues 56*a* and 56*b*. In the circumferential direction, the blocks 88 have a dimension which provides a relatively close fit within the slot 86 but allows the blocks to slide in the radial direction. The pins 80 actually pass through the blocks 88 rather than passing through a portion of the tongues 56*a* and 56*b*. Since the seal band segments extend fully around the rotor 20, they tend to position themselves within the grooves 48*a* and 48*b* such that the circumferential segments are substantially concentrically aligned about a rotational axis of the turbine. FIG. 4 is a radial view of the tongue and groove arrangement of FIG. 3 showing the pin 80 extending through the sidewalls of the diaphragm inner ring 40 and through the block 88**.

Figure 3:
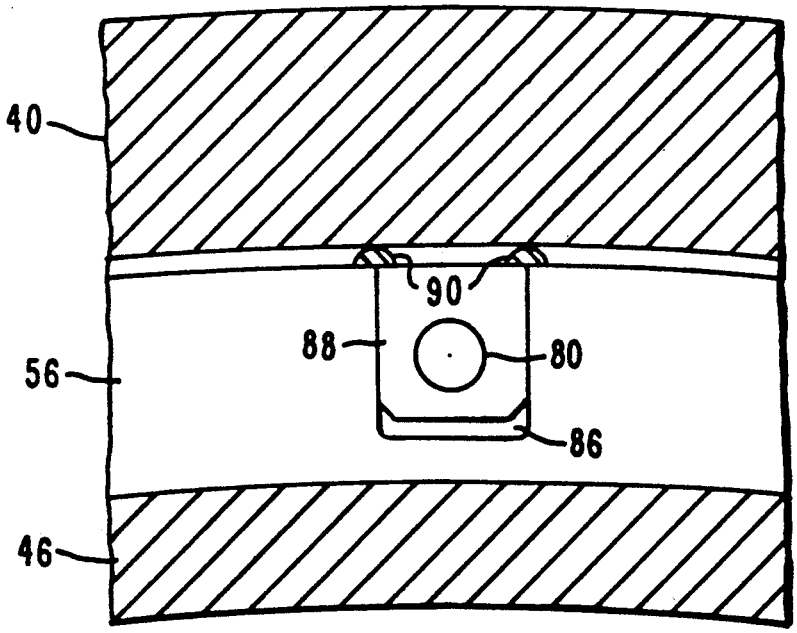
FIG. 3 is an enlarged sectional view taken transverse to the view of FIG. 2 and showing the arrangement of block, slot, tongue and groove for attaching a seal segment to an inner blade ring.

The semi-circles illustrated at 90 in FIG. 3 and as circles in FIG. 4 represent tack welds used for aligning the blocks 88 with respect to the tongues **56*a* and 56*b* for the purpose of drilling the aperture through the sidewalls of the inner ring 40 and the block 88. The blocks 88 are initially tack welded to the tongues 56*a* and 56*b* by the welds 90 so that their top surface is flush with the radially outer surface of the tongues 56*a* and 56*b*. The tongues 56*a* and 56*b* is then inserted within the grooves 48*a* and 48*b* and the apertures 82 drilled through the sidewalls of the inner ring 40 and through the block 88. The seal segment is then removed from its assembled position with the blade row diaphragm and the welds ground away in order to free the block 88 for movement within the slot 86**.

The seal bands 44 and 46 are then reassembled to respective first row blade diaphragms and the pins 80 installed passing through the sidewalls about the grooves 48*a* and 48*b* and through the hole which had been drilled through the block 88. In a preferred embodiment, six slots 86 and blocks 88 are used in each 180° half band segment for mounting the seal bands 44 and 46 to the blade diaphragm rings 40A and 40B, respectively. However, it will be appreciated that other numbers of blocks and slots may be utilized.

During operation, the sealing mechanism shown in FIG. 2 turns the flow of steam from a radially inward direction into an axial direction and onto the first annular rows of stationary blades 28, while at the same time minimizing any turbulence introduced into the flow of steam by such deflection. Since each of the seal ring bands 44 and 46 are only connected to one of the opposed pair of adjacent stationary blade row diaphragms, any thermal expansion or other axial movement which occurs relative to the opposed blade row diaphragms or with respect to the seal ring bands 44 and 46 will not tend to deform the blade rings 40A and 40B. Additionally, since the resilient seal 68 is only frictionally engaging the seal land ring 46, movement of the inner rings 40A and 40B in an axial direction will not result in the circumvention by the flow of steam from the desired flow path. Furthermore, since the seal bands 44 and 46 are not hard coupled to each of the inner rings 40A and 40B, room is provided to allow for radial expansion of the seal bands and of the first stationary blade row diaphragms without placing stress on the coupling. Movement of the blocks 88 within the slots 86 allow the seal bands 44, 46 to expand differentially in the radial direction with respect to the inner rings 40A and 40B. This arrangement of blocks and slots for connecting the seal bands to the diaphragm inner rings provides for a seal which fully floats about the rotor 20.

While the invention has been described and illustrated with reference to a specific embodiment, those skilled in the art will recognize that modifications and variations may be made without departing from the principals of the invention as described above and as set forth in the following claims. It is intended, therefore, that the invention not be limited to such embodiment but be interpreted within the spirit and scope of the appended claims.

What is claimed is:

1. In a double flow steam turbine having a rotor with annular rows of blades disposed about its periphery, a stator assembly connected about the rotor and having annular rows of stationary blades affixed thereto, the stator assembly including a steam inlet for directing a flow of steam onto at least a pair of first stage stationary blade rows in a desired steam flow path, each of the first stage stationary blade rows being positioned on opposite sides of the steam inlet and located for directing the flow of steam onto corresponding rows of rotor blades, at least the first stationary blade rows having an inner blade ring, apparatus for improving the efficiency of the steam turbine by reduction of steam bypassing the first stage blade rows via leakage around the inner blade rings including sealing means coupled between the inner blade rings of the first stage stationary blade rows, the sealing means including a first circumferential band coupled in sealing relationship to the inner blade ring of one of the first stage stationary blade rows and a second circumferential band coupled in sealing relationship to the inner blade ring of the other of the first stage stationary blade rows, at least a portion of the first band underlying at least a portion of the second band, a resilient seal positioned between the overlapping portions of the first and second bands and operative to prevent the leakage of steam therebetween, each of the first and second bands being connected to a corresponding one of the first stage stationary blade rows by connecting means allowing differential radial thermal expansion and contraction between the band and associated blade row, said connecting means comprising a circumferential groove formed in a radially inner surface of each of the inner blade rings, a tongue formed on each of the first and second bands and positioned to fit within a corresponding one of the grooves when the bands are assembled to a respective one of the inner blade rings, each of the tongues having a plurality of circumferentially spaced slots, a block positioned in each of the slots, each block being of a size to slidingly engage opposite circumferential sides of the slot and being shorter than a depth of the slot, the blocks being located within the groove when the bands are assembled to the inner blade rings, a plurality of pins each extending through the groove and a corresponding one of the blocks for fixing the blocks to the inner blade ring, whereby sliding motion of each of the blocks within its respective slot allows differential radial motion of the first and second bands with respect to their respective first and second inner blade rings while preventing circumferential rotation of the bands with respect to the blade rings.

2. The turbine of claim 1 and further including a circumferential groove formed in a radially outer surface of the at least a portion of the first band, the resilient seal being positioned in the circumferential groove in the outer surface with spring biasing means being positioned between the band and the seal for urging the seal radially outward and into contact with the at least a portion of the second band.

3. The turbine of claim 2 wherein the resilient seal comprises a labyrinth seal having a plurality of ridges contacting the second band.

4. The turbine of claim 3 wherein the at least a portion of the first band lies under the at least a portion of the second band such that axial thermal expansion of the turbine can occur without separation of the overlapping portions of the first and second bands.

5. A method of assembling a steam sealing arrangement adjacent a steam inlet of a double flow steam turbine in which the turbine includes a rotor with annular rows of blades disposed about its periphery, a stator assembly connected about the rotor and having annular rows of stationary blades affixed thereto, the stator assembly including a steam inlet for directing a flow of steam onto a pair of opposed first stage stationary blade rows in a desired steam flow path, the first stage stationary blade rows being positioned on opposite sides of the steam inlet and located for directing the flow of steam onto corresponding rows of the rotor blades, each of the first stage stationary blade rows having an inner blade ring, apparatus for improving the efficiency of the steam turbine by reduction of steam bypassing the first stage stationary blade rows via leakage around the inner blade rings including sealing means coupled between the inner blade rings of the first stage stationary blade rows, the sealing means including a first circumferential band coupled in sealing relationship to the inner blade ring of one of the first stage stationary blade rows and a second circumferential band coupled in sealing relationship to the inner blade ring of the other of the first stage stationary blade rows, at least a portion of the first band underlying at least a portion of the second band, a resilient seal positioned between the overlapping portions of the first and second bands and operative to prevent the leakage of steam therebetween, each of the first and second bands being connected to a corresponding one of the first stage stationary blade rows by connecting means allowing differential radial thermal expansion and contraction between the band and associated blade row, said connecting means comprising a circumferential groove formed in a radially inner surface of each of the inner blade rings, a tongue formed on each of the first and second bands and positioned to fit within a corresponding one of the grooves when the bands are assembled to a respective one of the inner blade rings, each of the tongues having a plurality of circumferentially spaced slots, a block positioned in each of the slots, each block being of a size to slidingly engage opposite circumferential sides of the slot and being shorter than a depth of the slot, the blocks being located within one of the grooves when the bands are assembled to the inner blade rings, a plurality of pins each extending through one of the grooves and a corresponding one of the blocks for fixing the blocks to the respective inner blade ring, the method comprising the steps of:

positioning the blocks in the slots with a radially outer surface of the blocks being flush with a radially outer surface of the tongues and axially oriented sides of the blocks being flush with axially oriented sides of the tongue;

tack welding the blocks in a location established by the step of positioning;

inserting the tongue of one of the bands into one of the grooves in a respective one of the first stage stationary blade rows prior to assembling the blade row in the turbine and orienting the band into a preselected position;

drilling a plurality of holes through at least one side wall of each of the inner blade rings and into the groove in the blade ring, each of the holes being predeterminately located to correspond to an approximate center of a corresponding one of the blocks, and continuing to drill through the block and into the opposite side wall of the groove;

separating the inner blade rings and the bands;

machining away the tack welds to free the blocks for radially slidable movement within the slots; and reassembling the bands to the respective inner blade rings and fitting the pins through each of the holes formed by the step of drilling and thereby retaining the bands to the inner blade rings.

6. The method of claim 5 wherein the bands and inner blade rings are assembled in 180 degree segments.

* * * * *